US011437717B2

(12) United States Patent
Shen et al.

(10) Patent No.: US 11,437,717 B2
(45) Date of Patent: Sep. 6, 2022

(54) ANTENNA SYSTEM

(71) Applicant: Askey Computer Corp., New Taipei (TW)

(72) Inventors: Su-Mei Shen, New Taipei (TW); Xing-Jia Chen, New Taipei (TW); Han-Lin Jhan, New Taipei (TW); Chih-Chung Lin, New Taipei (TW)

(73) Assignee: ASKEY COMPUTER CORP., New Taipei (TW)

( * ) Notice: Subject to any disclaimer, the term of this patent is extended or adjusted under 35 U.S.C. 154(b) by 2 days.

(21) Appl. No.: 17/301,991

(22) Filed: Apr. 21, 2021

(65) Prior Publication Data

US 2022/0102853 A1 Mar. 31, 2022

(30) Foreign Application Priority Data

Sep. 25, 2020 (CN) ..... 202011019561.8

(51) Int. Cl.

*H01Q 1/52* (2006.01)
*H01Q 1/48* (2006.01)
*H01Q 21/30* (2006.01)

(52) U.S. Cl.

CPC ..... *H01Q 1/523* (2013.01); *H01Q 1/48* (2013.01); *H01Q 21/30* (2013.01)

(58) Field of Classification Search

CPC .. H01Q 1/243; H01Q 1/48; H01Q 1/521–523; H01Q 5/30; H01Q 21/30

See application file for complete search history.

(56) References Cited

U.S. PATENT DOCUMENTS 9,008,728 B2 * 4/2015 Abdul-Gaffoor ..... H01Q 1/243 455/562.1
10,164,330 B2 * 12/2018 Wu ..... H01Q 1/52
10,916,851 B2 * 2/2021 Wei ..... H01Q 9/0407
11,011,837 B2 * 5/2021 Wu ..... H01Q 1/521

* cited by examiner

*Primary Examiner* — Hasan Islam

(74) *Attorney, Agent, or Firm* — McClure, Qualey & Rodack, LLP

(57) ABSTRACT

An antenna system is provided, including a ground plane, a first antenna unit, a second antenna unit, a first ground unit and a second ground unit. The ground plane includes a first side and a second side. The first ground unit and the ground plane jointly form a first closed loop, and a length of the first ground unit matches the first high-frequency signal and the second high-frequency signal to provide grounding of the high-frequency signals. The second ground unit forms a second closed loop and is connected to the first ground unit, and a length of the second ground unit is greater than the length of the first ground unit. A sum of the length of the second ground unit and the length of the first ground unit matches the first low-frequency signal and the second low-frequency signal, to jointly provide the grounding of the low-frequency signals.

10 Claims, 6 Drawing Sheets

ANTENNA SYSTEM

CROSS-REFERENCE TO RELATED APPLICATION

This non-provisional application claims priority under 35 U.S.C. § 119(a) to Patent Application No. 202011019561.8 filed in China, P.R.C. on Sep. 25, 2020, the entire contents of which are hereby incorporated by reference.

BACKGROUND

Technical Field

The present disclosure relates to an antenna system, and in particular, to an antenna system that uses a decoupling effect of a ground wire to achieve isolation.

Related Art

With the advancement of wireless communication technology, the demand for data transmission has also increased. To transmit a huge amount of data, a wireless communications system uses antenna system architecture of a multi-input multi-output (MIMO) system to realize wireless data transmission. In the MIMO system, two or more antenna architectures transmit different signals. However, when antenna isolation is relatively poor, antennas interfere with each other, resulting in signal loss and reducing the system transmission rate.

According to the conventional antenna design, a distance between two antennas needs to be at least greater than a specific distance to prevent mutual interference between the antennas and to achieve good antenna isolation. However, current electronic devices are oriented to miniaturization. For example, a mobile communication handheld device and a wearable device have reduced the size of electronic devices based on good user experience, thereby limiting a space where antennas can be installed. When two installed antennas cannot maintain at least a certain distance, consequently, the antenna isolation is relatively poor, and mutual interference occurs between the antennas, thereby reducing the transmission quality.

SUMMARY

In some embodiments, an antenna system includes a ground plane, a first antenna unit, a second antenna unit, a first ground unit and a second ground unit. The ground plane includes a first side and a second side. The first antenna unit is connected to the first side, where the first antenna unit is configured to receive and transmit a first high-frequency signal and a first low-frequency signal. The second antenna unit is connected to the second side, where the second antenna unit is configured to receive and transmit a second high-frequency signal and a second low-frequency signal. A closed end of the first ground unit is connected to the first side, and another closed end of the first ground unit is connected to the second side, to jointly form a first closed loop with the ground plane, and a physical length of the first ground unit matches the first high-frequency signal and the second high-frequency signal to provide grounding of the first high-frequency signal and the second high-frequency signal. The second ground unit forms a second closed loop, where the second ground unit is connected to the first ground unit, and a physical length of the second ground unit is greater than the physical length of the first ground unit. A sum of the physical length of the second ground unit and the physical length of the first ground unit matches the first low-frequency signal and the second low-frequency signal, and the second ground unit and the first ground unit jointly provide the grounding of the first low-frequency signal and the second low-frequency signal.

In some embodiments, an antenna system includes a ground plane, a first antenna unit, a second antenna unit, a first ground unit and a second ground unit. The ground plane includes a first side and a second side. The first antenna unit is connected to the first side, where the first antenna unit is configured to receive and transmit a first high-frequency signal and a first low-frequency signal. The second antenna unit is connected to the second side, where the second antenna unit is configured to receive and transmit a second high-frequency signal and a second low-frequency signal. A closed end of the first ground unit is connected to the first side, and another closed end of the first ground unit is connected to the second side, to jointly form a closed loop of the first ground unit with the ground plane, and a physical length of the first ground unit matches the first high-frequency signal and the second high-frequency signal to provide grounding of the first high-frequency signal and the second high-frequency signal. The second ground unit forms a closed loop of the second ground unit, where the second ground unit is connected to the first ground unit, and a physical length of the second ground unit is less than the physical length of the first ground unit. A sum of the physical length of the second ground unit and the physical length of the first ground unit matches the first low-frequency signal and the second low-frequency signal, and the second ground unit and the first ground unit jointly provide the grounding of the first low-frequency signal and the second low-frequency signal.

DETAILED DESCRIPTION

Figure 1:
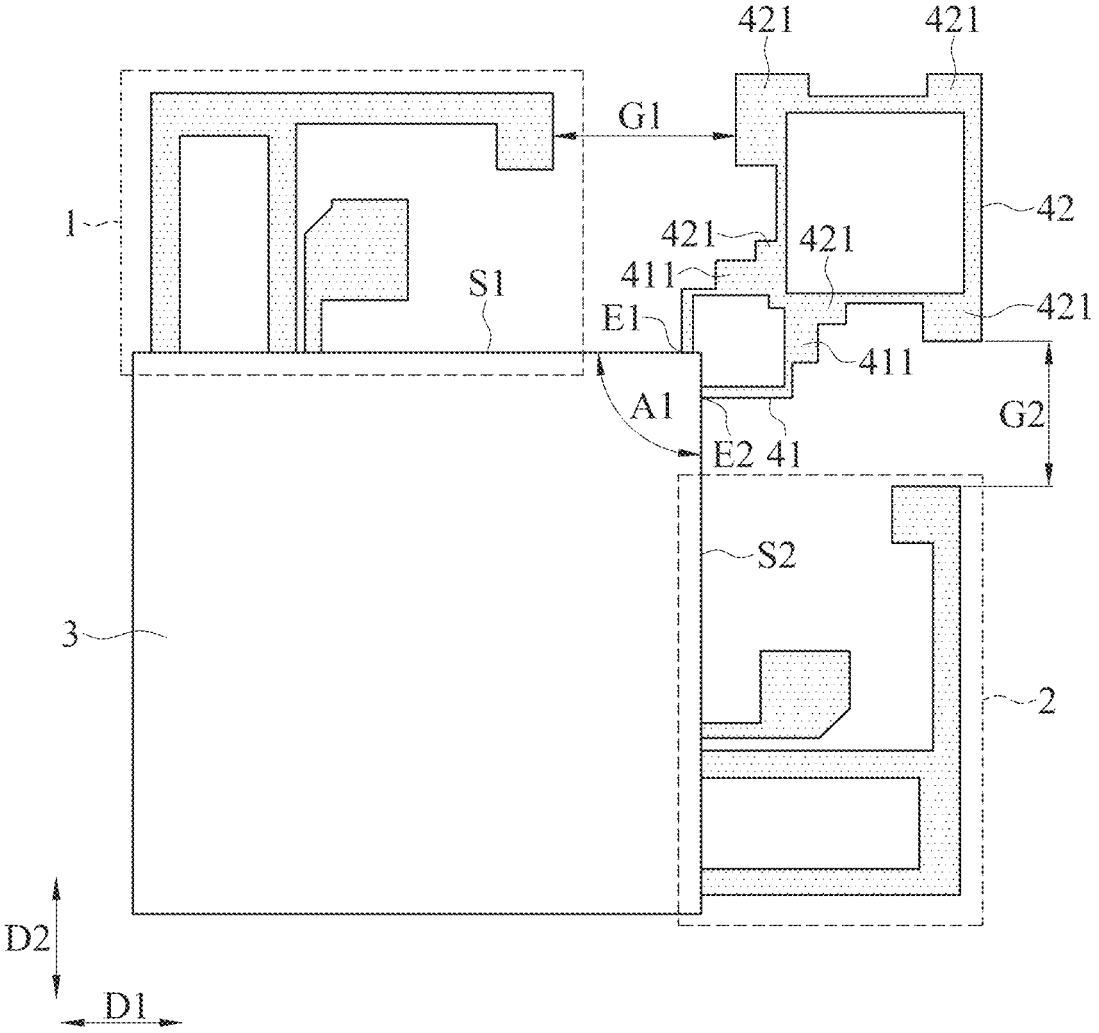
FIG. 1 is a schematic diagram of an embodiment of an antenna system according to the present disclosure.

Referring to FIG. 1, FIG. 1 is an antenna system that uses a decoupling effect of a ground wire to achieve isolation. The antenna system includes two antenna units (referred to as a first antenna unit 1 and a second antenna unit 2 respectively for easy description) supporting dual-frequency signals, two ground units (referred to as a first ground unit 41 and a second ground unit 42 respectively), and a ground plane 3. The ground plane 3 includes a first side S1 and a second side S2. The first antenna unit 1 is connected to the first side Si and grounded, and the second antenna unit 2 is connected to the second side S2 and grounded.

The first ground unit 41 includes two closed ends E1 and E2. The closed end E1 is connected to the first side S1, and the closed end E2 is connected to the second side S2. Therefore, the first ground unit 41, the first side S1, and the second side S2 jointly form a closed loop (hereinafter referred to as a first closed loop). The second ground unit 42 is connected to the first ground unit 41. A physical length of the second ground unit 42 is greater than a physical length of the first ground unit 41. The second ground unit 42 alone forms another closed loop (hereinafter referred to as a second closed loop). The first ground unit 41 and the second ground unit 42 can further provide grounding of the first antenna unit 1 and the second antenna unit 2.

Specifically, the first antenna unit 1 can receive and transmit a high-frequency signal (hereinafter referred to as a first high-frequency signal), and the first antenna unit 1 can receive and transmit a low-frequency signal (hereinafter referred to as a first low-frequency signal). There is a first coupling distance G1 between the first antenna unit 1 and the ground units 41 and 42. Based on the first high-frequency signal, the physical length of the first ground unit 41 matches the first high-frequency signal, that is, the first closed loop matches the first high-frequency signal. In other words, the physical length of the first ground unit 41 is substantially ¼ of the wavelength of the first high-frequency signal. Compared to original grounding of the first antenna unit 1, the first ground unit 41 can further provide grounding of the first high-frequency signal. In addition, based on the first low-frequency signal, a sum of the physical length of the first ground unit 41 and the physical length of the second ground unit 42 matches the first low-frequency signal, that is, the first closed loop and the second closed loop jointly match the first low-frequency signal. In other words, the sum of the physical length of the first ground unit 41 and the physical length of the second ground unit 42 is substantially ¼ of the wavelength of the first low-frequency signal. The first ground unit 41 and the second ground unit 42 can jointly further provide grounding of the first low-frequency signal.

The second antenna unit 2 can receive and transmit a high-frequency signal (hereinafter referred to as a second high-frequency signal), and the second antenna unit 2 can receive and transmit a low-frequency signal (hereinafter referred to as a second low-frequency signal). There is a second coupling distance G2 between the second antenna unit 2 and the ground units 41 and 42. Based on the second high-frequency signal, the physical length of the first ground unit 41 matches the second high-frequency signal, that is, the first closed loop matches the second high-frequency signal. In other words, the physical length of the first ground unit 41 is substantially ¼ of the wavelength of the second high-frequency signal. Compared to original grounding of the second antenna unit 2, the first ground unit 41 can further provide grounding of the second high-frequency signal. In addition, based on the second low-frequency signal, a sum of the physical length of the first ground unit 41 and the physical length of the second ground unit 42 also matches the second low-frequency signal, that is, the first closed loop and the second closed loop also jointly match the second low-frequency signal. In other words, the sum of the physical length of the first ground unit 41 and the physical length of the second ground unit 42 is substantially ¼ of the wavelength of the second low-frequency signal. The first ground unit 41 and the second ground unit 42 can jointly further provide grounding of the second low-frequency signal.

Figure 2:
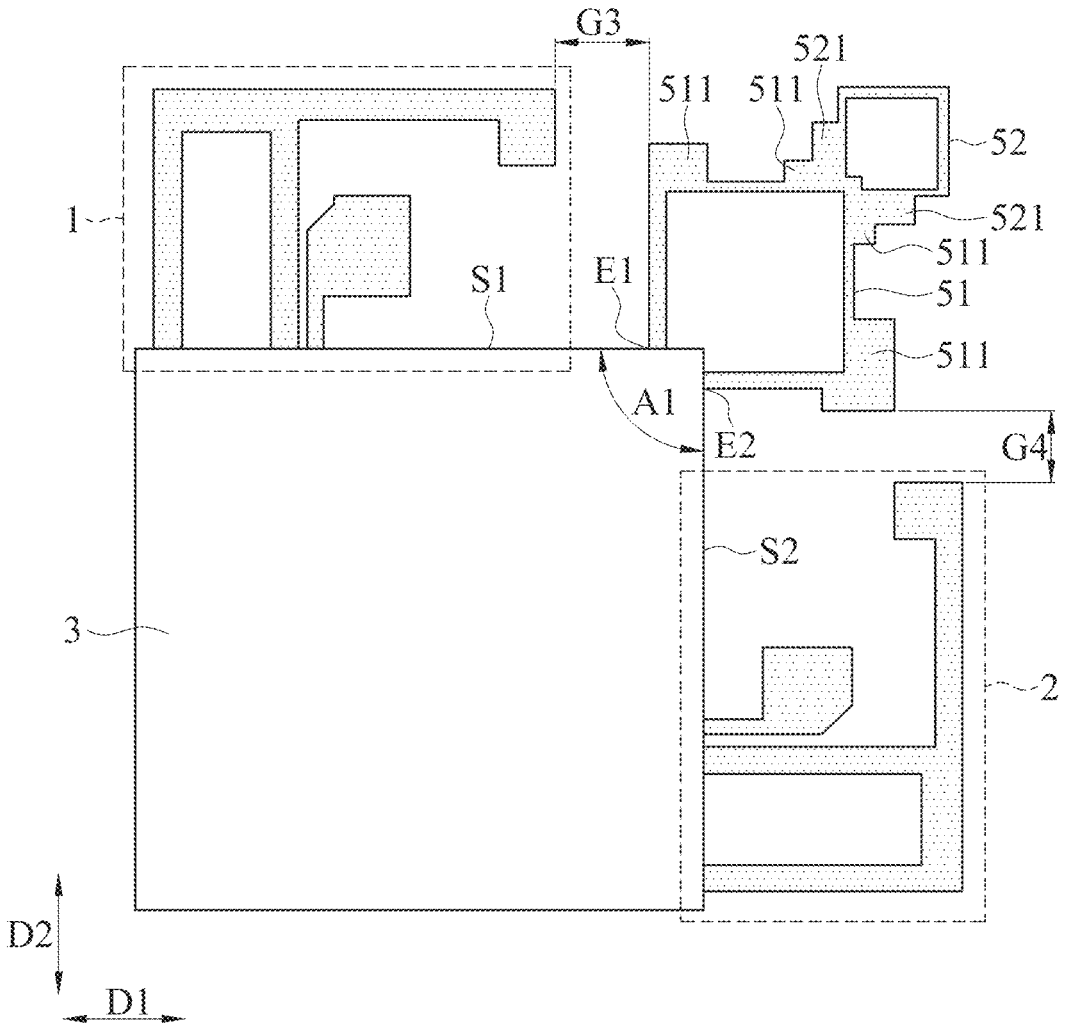
FIG. 2 is a schematic diagram of another embodiment of an antenna system according to the present disclosure.

In another embodiment, referring to FIG. 2, FIG. 2 is a schematic diagram of another embodiment of an antenna system according to the present disclosure. The difference between the antenna system in FIG. 2 and the antenna system in FIG. 1 is that FIG. 2 illustrates a first ground unit 51 and a second ground unit 52, where a physical length of the first ground unit 51 is greater than a physical length of the second ground unit 52. Specifically, the first ground unit 51 includes two closed ends E1 and E2. The closed end E1 is connected to the first side S1, and the closed end E2 is connected to the second side S2. Therefore, the first ground unit 51, the first side S1, and the second side S2 jointly form a closed loop (hereinafter referred to as a first closed loop). The second ground unit 52 is connected to the first ground unit 51. The physical length of the second ground unit 52 is less than the physical length of the first ground unit 51. The second ground unit 52 alone forms another closed loop (hereinafter referred to as a second closed loop). The first ground unit 51 and the second ground unit 52 can further provide grounding of the first antenna unit 1 and the second antenna unit 2.

There is a third coupling distance G3 between the first antenna unit 1 and the ground units 51 and 52. Based on the first high-frequency signal, the physical length of the first ground unit 51 matches the first high-frequency signal, that is, the first closed loop matches the first high-frequency signal. In other words, the physical length of the first ground unit 51 is substantially ¼ of the wavelength of the first high-frequency signal. Compared to original grounding of the first antenna unit 1, the first ground unit 51 can further provide grounding of the first high-frequency signal. In addition, based on the first low-frequency signal, a sum of the physical length of the first ground unit 51 and the physical length of the second ground unit 52 matches the first low-frequency signal, that is, the first closed loop and the second closed loop jointly match the first low-frequency signal. In other words, the sum of the physical length of the first ground unit 51 and the physical length of the second ground unit 52 is substantially ¼ of the wavelength of the first low-frequency signal. The first ground unit 51 and the second ground unit 52 can jointly further provide grounding of the first low-frequency signal.

There is a fourth coupling distance G4 between the second antenna unit 2 and the ground units 51 and 52. Based on the second high-frequency signal, the physical length of the first ground unit 51 matches the second high-frequency signal, that is, the first closed loop also matches the second high-frequency signal. In other words, the physical length of the first ground unit 51 is substantially ¼ of the wavelength of the second high-frequency signal. Compared to original grounding of the second antenna unit 2, the first ground unit 51 can further provide grounding of the second high-frequency signal. In addition, based on the second low-frequency signal, a sum of the physical length of the first ground unit 51 and the physical length of the second ground unit 52 also matches the second low-frequency signal, that is, the first closed loop and the second closed loop also jointly match the second low-frequency signal. In other words, the sum of the physical length of the first ground unit 51 and the physical length of the second ground unit 52 is substantially ¼ of the wavelength of the second low-frequency signal. The first ground unit 51 and the second ground unit 52 can jointly further provide grounding of the second low-frequency signal.

Based on this, when a feed signal excites the antenna units 1 and 2 respectively, by configuration of the first ground unit 41, 51, and the second ground unit 42, 52, the first ground unit 41, 51, and the second ground unit 42, 52 can further provide grounding of the antenna units 1 and 2 when receiving and transmitting high-frequency and low-frequency signals, so that a distance between the first antenna unit 1 and the second antenna unit 2 is relatively small without mutual interference, and the antenna system has good antenna isolation, thereby maintaining good transmission quality of the antenna system.

In some embodiments, as shown in FIG. 1 and FIG. 2, the ground plane 3 includes two or more sides. An angle A1 is formed between a first side S1 and a second side S2 adjacent to each other among the plurality of sides. The angle A1 may be an angle less than 180 degrees, that is, the first side S1 and the second side S2 intersect but are not in a straight line. In some embodiments, the first side S1 of the ground plane 3 may be perpendicular to the second side S2, and the first side S1 and the second side S2 intersect to form an angle A1 of 90 degrees.

In some embodiments, as shown in FIG. 1 and FIG. 2, the closed end E1 of the first ground unit 41, 51 is connected to the first side S1, and the closed end E2 is connected to the second side S2. In other words, the first ground unit 41, 51 is disposed on a reflex angle that has the same vertex as the angle A1 and that is complementary to the angle A1 in a circle (360 degree angle). The closed ends E1 and E2 are respectively connected to two sides of the reflex angle, and the opposite sides of the reflex angle are the first side S1 and the second side S2. The second ground unit 42, 52 is connected to the first ground unit 41, 51. When the first ground unit 41, 51, and the second ground unit 42, 52 are vertically projected along a first projection direction D1 parallel to the first side S1, vertical projections of the first ground unit 41, 51 and the second ground unit 42, 52 at least partially overlap on the first antenna unit 1; and when the second antenna unit 2 is vertically projected along the first projection direction D1, a vertical projection of the second antenna unit 2 does not overlap on the first antenna unit 1. In another respect, when the first ground unit 41, 51, and the second ground unit 42, 52 are vertically projected along a second projection direction D2 parallel to the second side S2, vertical projections of the first ground unit 41, 51 and the second ground unit 42, 52 at least partially overlap on the second antenna unit 2; and when the first antenna unit 1 is vertically projected along the second projection direction D2, a vertical projection of the first antenna unit 1 does not overlap on the second antenna unit 2.

Figure 3:
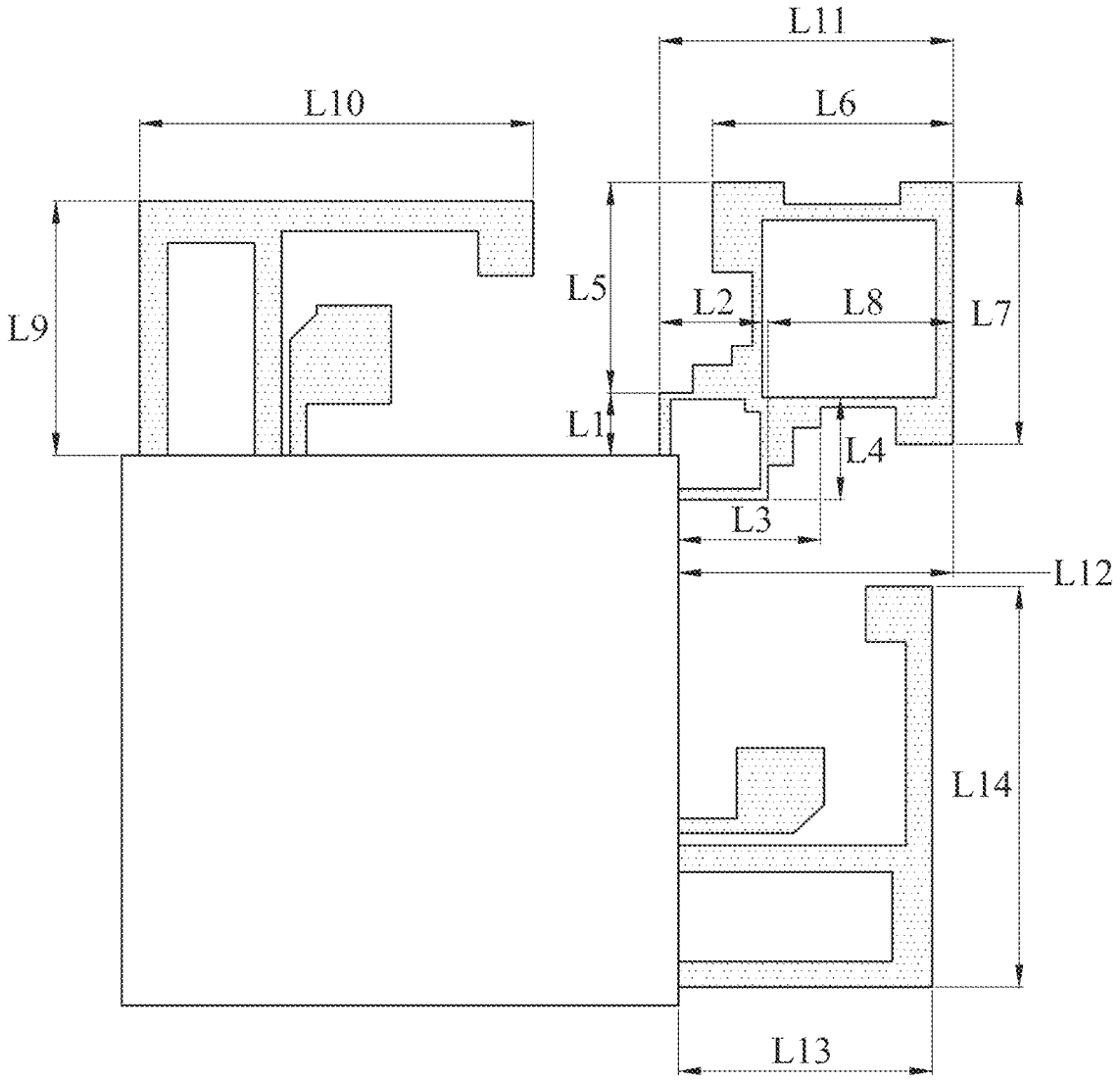
FIG. 3 is a schematic diagram of an embodiment of a size of the antenna system in FIG. 1.

In some embodiments, referring to FIG. 3, a length L1 may be 2.25 millimeters (mm), a length L2 may be 3.5 mm, a length L3 may be 5.25 mm, a length L4 may be 3.5 mm, a length L5 may be 8.05 mm, a Length L6 may be 9.25 mm, a length L7 may be 9.8 mm, a length L8 may be 7.25 mm, a length L9 may be 10 mm, a length L10 may be 15.5 mm, a length L11 may be 11.25 mm, a length L12 may be 10.5 mm, a length L13 may be 10 mm, a length L14 may be 15.5 mm, lengths of the first coupling distance G1, the second coupling distance G2, the third coupling distance G3, and the fourth coupling distance G4 may be 5 mm to 10 mm.

Figure 4:
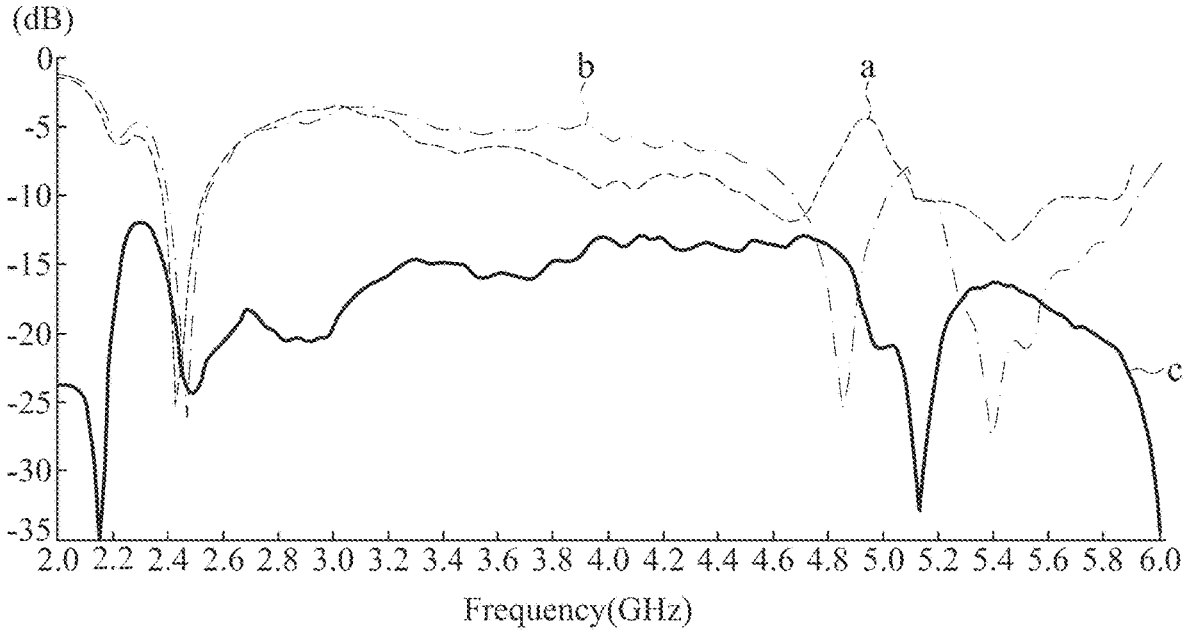
FIG. 4 is a diagram showing reflection losses at various operating frequencies of an embodiment of the antenna system in FIG. 1.

In some embodiments, referring to FIG. 4, FIG. 4 is a diagram showing reflection losses at various operating frequencies of the antenna system in FIG. 1. A curve a represents the first antenna unit 1, a curve b represents the second antenna unit 2, and a curve c represents antenna isolation, which is an indicator of antenna interference. It can be learned from FIG. 4 that high-frequency operating bands of the first antenna unit 1 and the second antenna unit 2 may be distributed in a range of 5 GHz to 6 GHz, and low-frequency operating bands are distributed in a range of 2.4 GHz to 2.5 GHz.

Figure 5:
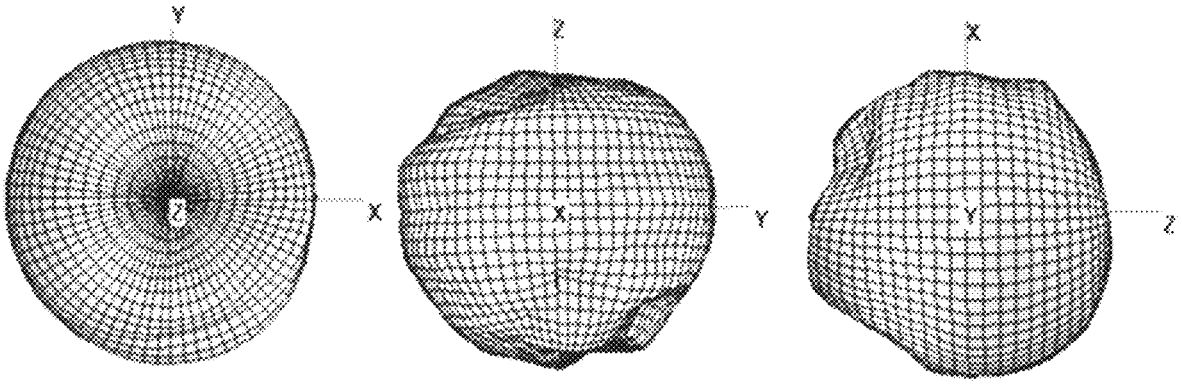
FIG. 5 is a diagram of a radiation pattern formed in an embodiment of a first antenna unit of the antenna system in FIG. 1.
Figure 6:
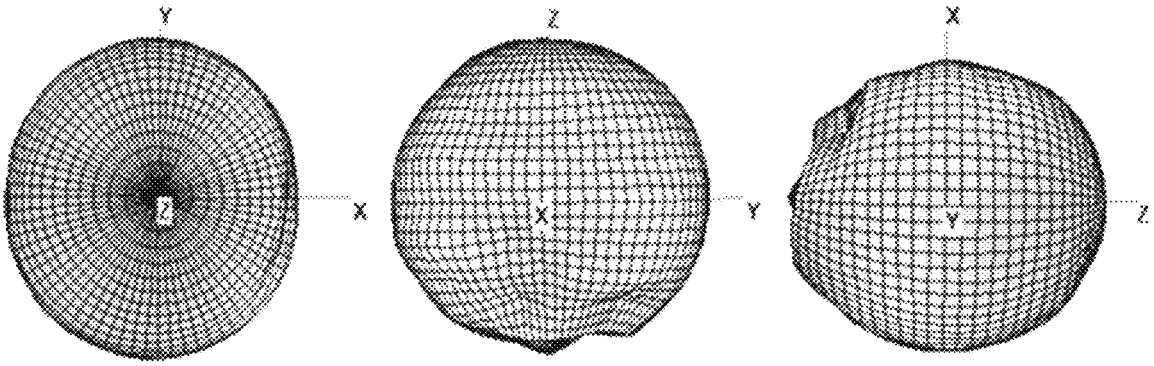
FIG. 6 is a diagram of a radiation pattern formed in an embodiment of a second antenna unit of the antenna system in FIG. 1.
Figure 7:
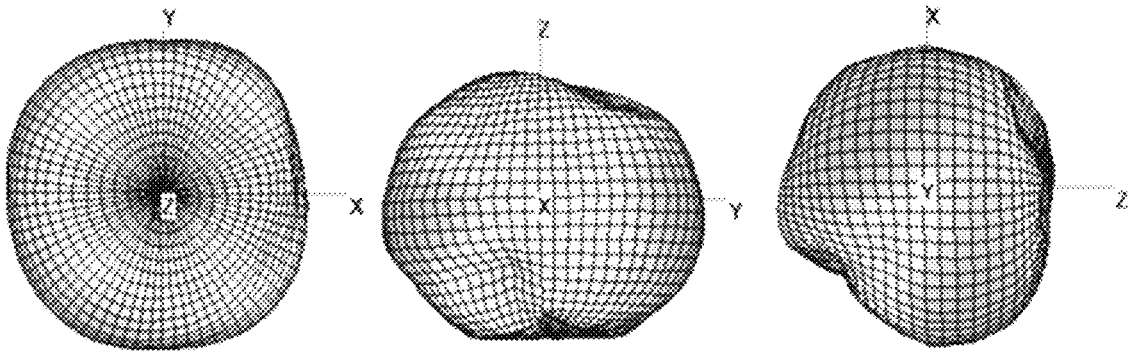
FIG. 7 is a diagram of a radiation pattern formed in another embodiment of a first antenna unit of the antenna system in FIG. 1.
Figure 8:
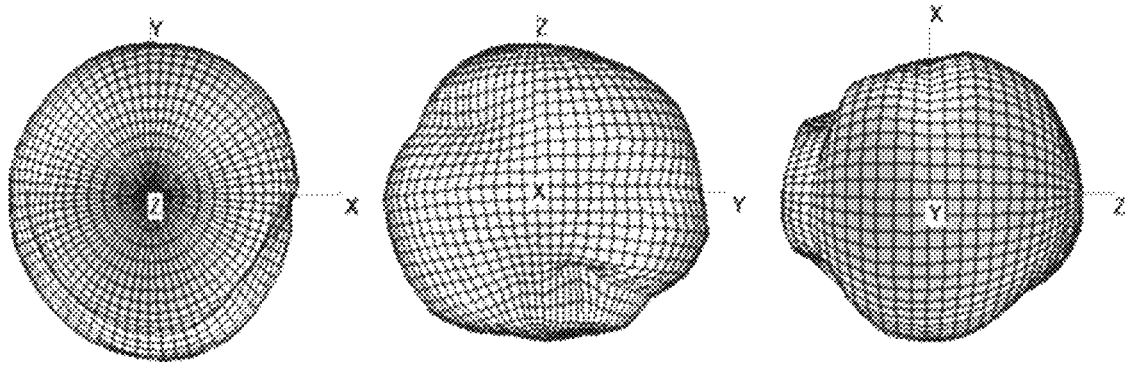
FIG. 8 is a diagram of radiation pattern formed in another embodiment of a second antenna unit of the antenna system in FIG. 1.

In some embodiments, refer to FIG. 5 to FIG. 8 together. FIG. 5 and FIG. 6 show radiation patterns generated when the first antenna unit 1 and the second antenna unit 2 of the antenna system in FIG. 1 respectively operate at a low-frequency operating band of 2.45 GHz. FIG. 7 and FIG. 8 show radiation patterns generated when the first antenna unit 1 and the second antenna unit 2 of the antenna system in FIG. 1 respectively operate at a high-frequency operating band of 5.5 GHz. A peak gain of the radiation pattern in FIG. 5 may be 2.57 dBi, and efficiency may be 55.66%; a peak gain of the radiation pattern in FIG. 6 may be 0.71 dBi, and efficiency may be 59.27%; a peak gain of the radiation pattern in FIG. 7 may be 2.62 dBi, and efficiency may be 60.33%; and a peak gain of the radiation pattern in FIG. 8 may be 3.58 dBi, and efficiency can be 61.41%. It can be learned from FIG. 5 to FIG. 8 that the antenna system provided with the ground units 41 and 42 has excellent radiation pattern energy, maximum gain and efficiency value. Based on this, configuration of grounding units in the antenna system can effectively isolate mutual interference generated between antenna units, thereby enhancing the overall reception quality of the antenna system.

In some embodiments, the first ground unit 41, 51, and the second ground unit 42, 52 may be in any geometric shape. When space for an antenna system in an electronic device is limited, widths of the first ground unit 41, 51, and the second ground unit 42, 52 may be increased partially to shorten a length of the closed loop of the first ground unit 41, 51 (that is, to shorten a length between the closed end E1 and the closed end E2 of the first ground unit 41, 51), and a length of the closed loop of the second ground unit 42, 52. Specifically, for example, the first ground unit 41, 51, and the second ground unit 42, 52 shown in FIG. 1 and FIG. 2 are respectively square shaped, a protruding part 411 is disposed at one right angle of the first ground unit 41, protruding parts 421 are disposed at four right angles of the second ground unit 42, protruding parts 511 are disposed at three right angles of the first ground unit 51, and a protruding part 521 is disposed at one right angle of the second ground unit 52. Based on this, when the space for the antenna system in the electronic device is limited, the first ground unit 41, 51, and the second ground unit 42, 52 can provide, through the protruding parts 411, 421, 511, and 521 that increase partial widths, grounding of high-frequency or low-frequency signals for the first ground unit 41, 51, and the second ground unit 42, 52, so that antenna units can continuously provide the overall good reception quality of the antenna system when receiving and transmitting high-frequency or low-frequency signals.

In some embodiments, the antenna system may be printed on a printed circuit board (PCB). The first antenna unit 1, the second antenna unit 2, the first ground unit 41, 51, and the second ground unit 42, 52 may be metal traces on the printed circuit board. The first antenna unit 1, the second antenna unit 2, the first ground unit 41, 51, and the second ground unit 42, 52 may be made of conductive materials (silver, copper, aluminum, iron, or alloys thereof). The ground plane 3 may be a common ground plane applied to a metal casing of the electronic device of the antenna system or each electronic component of the electronic device. In some embodiments, the first antenna unit 1 and the second antenna unit 2 may be designed as planar inverted-F antennas (PIFA).

To sum up, according to an embodiment of the antenna system of the present disclosure, two antenna units are not limited to the size of the electronic device during configuration. When the two antennas cannot maintain at least a certain distance due to a relatively small size of the electronic device, the antenna system can provide grounding of high-frequency or low-frequency signals according to the grounding units, so that the antenna units maintain good antenna isolation when receiving and transmitting high-frequency or low-frequency signals, and mutual interference between antenna units due to a close distance can be avoided, thereby enhancing good transmission quality of the antenna system. In addition, as the electronic device maintains a relatively small size, the manufacturing cost of the electronic device is reduced.

Although the present disclosure has been described in considerable detail with reference to certain preferred embodiments thereof, the disclosure is not for limiting the scope of the disclosure. Persons having ordinary skill in the art may make various modifications and changes without departing from the scope and spirit of the disclosure. Therefore, the scope of the appended claims should not be limited to the description of the preferred embodiments described above.

What is claimed is:

1. An antenna system, comprising:

a ground plane, comprising a first side and a second side;

a first antenna unit, connected to the first side, wherein the first antenna unit is configured to receive and transmit a first high-frequency signal and a first low-frequency signal;

a second antenna unit, connected to the second side, wherein the second antenna unit is configured to receive and transmit a second high-frequency signal and a second low-frequency signal;

a first ground unit, wherein a closed end of the first ground unit is connected to the first side, and another closed end of the first ground unit is connected to the second side, to jointly form a first closed loop with the ground plane, and a physical length of the first ground unit matches the first high-frequency signal and the second high-frequency signal to provide grounding of the first high-frequency signal and the second high-frequency signal; and a second ground unit, forming a second closed loop, wherein the second ground unit is connected to the first ground unit, and a physical length of the second ground unit is greater than the physical length of the first ground unit, wherein a sum of the physical length of the second ground unit and the physical length of the first ground unit matches the first low-frequency signal and the second low-frequency signal, and the second ground unit and the first ground unit jointly provide the grounding of the first low-frequency signal and the second low-frequency signal.

2. The antenna system according to claim 1, wherein an angle between the first side and the second side is less than 180 degrees.

3. The antenna system according to claim 2, wherein the first side is perpendicular to the second side.

4. The antenna system according to claim 1, wherein vertical projections of the first ground unit and the second ground unit along a first projection direction parallel to the first side overlap on the first antenna unit.

5. The antenna system according to claim 4, wherein vertical projections of the first ground unit and the second ground unit along a second projection direction parallel to the second side overlap on the second antenna unit, and the first projection direction is perpendicular to the second projection direction.

6. An antenna system, comprising:

a ground plane, comprising a first side and a second side;

a first antenna unit, connected to the first side, wherein the first antenna unit is configured to receive and transmit a first high-frequency signal and a first low-frequency signal;

a second antenna unit, connected to the second side, wherein the second antenna unit is configured to receive and transmit a second high-frequency signal and a second low-frequency signal;

a first ground unit, wherein a closed end of the first ground unit is connected to the first side, and another closed end of the first ground unit is connected to the second side, to jointly form a closed loop of the first ground unit with the ground plane, and a physical length of the first ground unit matches the first high-frequency signal and the second high-frequency signal to provide grounding of the first high-frequency signal and the second high-frequency signal; and a second ground unit, forming a closed loop of the second ground unit, wherein the second ground unit is connected to the first ground unit, and a physical length of the second ground unit is less than the physical length of the first ground unit, wherein a sum of the physical length of the second ground unit and the physical length of the first ground unit matches the first low-frequency signal and the second low-frequency signal, and the second ground unit and the first ground unit jointly provide the grounding of the first low-frequency signal and the second low-frequency signal.

7. The antenna system according to claim 6, wherein an angle between the first side and the second side is greater than 0 degree.

8. The antenna system according to claim 7, wherein the first side is perpendicular to the second side.

9. The antenna system according to claim 6, wherein vertical projections of the first ground unit and the second ground unit along a first projection direction parallel to the first side overlap on the first antenna unit.

10. The antenna system according to claim 9, wherein vertical projections of the first ground unit and the second ground unit along a second projection direction parallel to the second side overlap on the second antenna unit, and the first projection direction is perpendicular to the second projection direction.

* * * * *